US007509083B2

(12) United States Patent
Inui et al.

(10) Patent No.: US 7,509,083 B2
(45) Date of Patent: Mar. 24, 2009

(54) IMAGE FORMING APPARATUS AND GUIDE UNIT, TRANSPORT UNIT USED THEREIN

(75) Inventors: Hiroshi Inui, Osaka (JP); Takeshi Watanabe, Hyogo (JP)

(73) Assignee: Kyocera Mita Corporation, Osaka (JP)

( * ) Notice: Subject to any disclaimer, the term of this patent is extended or adjusted under 35 U.S.C. 154(b) by 119 days.

(21) Appl. No.: 11/790,057

(22) Filed: Apr. 23, 2007

(65) Prior Publication Data

US 2007/0253755 A1 Nov. 1, 2007

(30) Foreign Application Priority Data

Apr. 28, 2006 (JP) ..... 2006-126402

(51) Int. Cl.
*G03G 15/16* (2006.01)

(52) U.S. Cl. ..... 399/316; 399/66

(58) Field of Classification Search ..... 399/316, 399/388, 297, 66, 310
See application file for complete search history.

(56) References Cited

U.S. PATENT DOCUMENTS 4,673,280 A * 6/1987 Milton ..... 399/316
5,926,682 A * 7/1999 Tomiki ..... 399/388
6,125,244 A * 9/2000 Kamiya ..... 399/388 X
6,259,885 B1 * 7/2001 Ohkubo et al. ..... 399/388
2002/0131801 A1 * 9/2002 Tomatsu ..... 399/400
2004/0253025 A1 * 12/2004 Matsuura ..... 399/316

FOREIGN PATENT DOCUMENTS

JP 63-226681 A * 9/1988
JP 11-184269 A 7/1999
JP 2001-139185 A * 5/2001

* cited by examiner

*Primary Examiner*—Sophia S Chen
(74) *Attorney, Agent, or Firm*—Global IP Counselors LLP

(57) ABSTRACT

A guide unit 24 includes an electrically conducting guide plate 25 disposed upstream of the transfer unit 20 that transports toner image transfer sheets between the image carrier 7 and the transfer unit 20, an electrically insulating support member 26 that supports the guide plate 25, an electrically conducting connecting member 30 installed on the support member 26, electrically connected to a ground plate 33, and a non-linear element 31 directly or indirectly electrically connected between the guide plate 25 and the connecting member 30. Further, if a voltage equal to or greater than a predetermined value is applied between the guide plate 25 and the connecting member 30, the resistance value is reduced.

8 Claims, 7 Drawing Sheets

IMAGE FORMING APPARATUS AND GUIDE UNIT, TRANSPORT UNIT USED THEREIN

CROSS-REFERENCE TO RELATED APPLICATIONS

This application claims priority to Japanese Patent Application No. 2006-126402 filed on Apr. 28, 2006. The entire disclosure of Japanese Patent Application No. 2006-126402 is hereby incorporated herein by reference.

BACKGROUND OF THE INVENTION

1. Field of the Invention

The present invention generally relates to an image forming apparatus having a transport unit with a guide unit. More specifically, the present invention relates to a guide unit having a guide plate that transports sheets, a transport unit having a guide unit, and an image forming apparatus having a transport unit.

2. Background Information

Normally an image forming apparatus such as a printer, fax, or photocopier, includes an image forming unit in which toner images are formed and the toner images are transferred onto sheets, a fixing unit in which the transferred toner images are fixed to the sheets, and so on.

The image forming unit includes a photosensitive drum, a charging unit that charges the surface of the photosensitive drum, a light exposure unit that forms electrostatic latent images by decharging part of the charged area of the photosensitive drum, a developing unit that forms toner images based on the electrostatic latent images, a transfer unit that transfers the toner images onto sheets, a cleaning unit that cleans the surface of the photosensitive drum, and so on.

The transfer unit transfers toner images formed on the photosensitive drum onto sheets transported between the photosensitive drum and the transfer unit by applying a bias voltage to the transfer unit with a polarity opposite to that of the toner.

Here, to transport the sheets between the photosensitive drum and the transfer unit, a guide plate is disposed on the upstream side of the transfer unit in the direction of transport of the sheets, and the sheets are transported along the guide plate.

If a guide plate manufactured from resin is used, the guide plate can become charged as a result of friction with the sheets, and if dust adheres to the guide plate, defective sheet transport or defective toner transfer can be caused by this dust.

Therefore, as disclosed for example in Japanese Laid-open Patent Application No. H11-184269, a grounded metal guide plate is used to prevent charging of the guide plate.

Here, if a grounded metal guide plate is used in highly humid environments the resistance value of the sheet is reduced, and transfer current from the transfer unit can flow to the guide plate through the sheet. Therefore, under this type of environment the toner image may not be sufficiently transferred to the sheet, and transfer defects can occur.

In view of the above, it will be apparent to those skilled in the art from this disclosure that there exists a need for an improved image forming apparatus having a transport unit with a guide unit. This invention addresses this need in the art as well as other needs, which will become apparent to those skilled in the art from this disclosure.

SUMMARY OF THE INVENTION

With the foregoing problems of conventional guide units in mind, it is an object of the present invention to provide a guide unit that is capable of suppressing the flow of transfer current to the guide plate, a transport unit, and an image forming apparatus.

The image forming apparatus guide unit according to the first aspect of the present invention is a guide unit provided in an image forming apparatus that guides toner image transfer sheets between an image carrier and a transfer device. The image forming apparatus guide unit has an electrically conducting guide plate, an electrically insulating support member, an electrically conducting connecting member, and a non-linear element. The guide plate is disposed upstream of the transfer device in the direction of transport of sheets. The support member supports the guide plate. The connecting member is installed on the support member, and is connected to a ground plate provided on the main body of the image forming apparatus. The non-linear element is electrically connected between the guide plate and the connecting member, and if a voltage equal to or greater than a predetermined value is applied to the guide plate, the resistance value is reduced compared with the case where the applied voltage is not greater than the predetermined value.

An image forming apparatus guide plate according to a second aspect of the present invention is the apparatus of the first aspect, wherein the non-linear element is a varistor or a Zener diode.

An image forming apparatus guide plate according to a third aspect of the present invention is the apparatus of the first aspect, wherein the predetermined value can be changed in accordance with the non-linear element.

An image forming apparatus guide plate according to a fourth aspect of the present invention is the apparatus of the first aspect, wherein the connecting member is an elastic plate-shaped member, and the surface of the connecting member that contacts the ground plate is pressed against the ground plate by the elastic force of the connecting member.

An image forming apparatus transport unit according to a fifth aspect of the present invention is a transport unit provided in an image forming apparatus having an image carrier that transports toner image transfer sheets. The transport unit has a transfer device, a registration roller, and a guide unit. The transfer device is a device that transfers toner images formed on the image carrier to transported sheets. The registration roller is disposed upstream of the transfer device in the direction of transport of the sheets, that corrects slanted feeding of the sheets. The guide unit is provided between the transfer device and the registration roller, and guides toner image transfer sheets between the image carrier and the transfer device. Also, the guide unit includes an electrically conducting guide plate, an electrically insulating support member, an electrically conducting connecting member, and a non-linear element. The guide plate is disposed upstream of the transfer device in the direction of transport of sheets. The support member supports the guide plate. The connecting member is installed on the support member, connected to a ground plate provided on the main body of the image forming apparatus. The non-linear element is electrically connected between the guide plate and the connecting member, and if a voltage equal to or greater than a predetermined value is applied to the guide plate, the resistance value is reduced compared to a case in which the applied voltage is not greater than the predetermined value.

An image forming apparatus transport unit according to a sixth aspect of the present invention is the unit of the fifth aspect, further including a pair of installation plates each having a through hole, provided at both ends in the lengthwise direction at right angles to the direction of transport of the sheets. Also, the guide unit is provided with projections at both ends in the long direction that project outward, and are inserted into the through holes to support the guide unit on the installation plates.

An image forming apparatus according to a seventh aspect of the present invention has a sheet supply cassette, an image forming unit, a fixing unit, a transport unit, and a discharge tray. The sheet supply cassette houses toner image transfer sheets. The image forming unit has an image carrier on the surface of which toner images are formed. The fixing unit fixes toner images onto sheets. The transport unit transports sheets from the sheet supply cassette to the fixing unit. Sheets discharged from the fixing unit are discharged to the discharge tray. The transport unit includes a transfer device, a registration roller, and a guide unit. The transfer device is a device that transfers toner images formed on the image carrier to transported sheets. The registration roller is disposed upstream of the transfer device in the direction of transport of the sheets, and corrects slanted feeding of the sheets. The guide unit is provided between the transfer device and the registration roller, and guides toner image transfer sheets between the image carrier and the transfer device. Also, the guide unit includes an electrically conducting guide plate, an electrically insulating support member, an electrically conducting connecting member, and a non-linear element. The guide plate is disposed upstream of the transfer device in the direction of transport of sheets. The support member supports the guide plate. The connecting member is installed on the support member, connected to a ground plate provided on the main body of the image forming apparatus. The non-linear element is electrically connected between the guide plate and the connecting member, and if a voltage equal to or greater than a predetermined value is applied to the guide plate, the resistance value is reduced compared to a case in which the applied voltage is not greater than the predetermined value.

An image forming apparatus according to an eighth aspect of the present invention is the apparatus of the seventh aspect, wherein the transfer device includes a transfer roller, and the transfer roller presses against the image carrier.

According to the present invention, it is possible to provide a guide unit capable of suppressing the flow of transfer current to the guide plate, a transport unit, and an image forming apparatus.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The following is an explanation of a transport unit 22 according to a preferred embodiment of the present invention with reference to the drawings. In addition, an example of a guide unit 24 according to the present invention is described.

First, the overall structure of a photocopier that uses the transport unit according to the present embodiment is explained.

Figure 1:
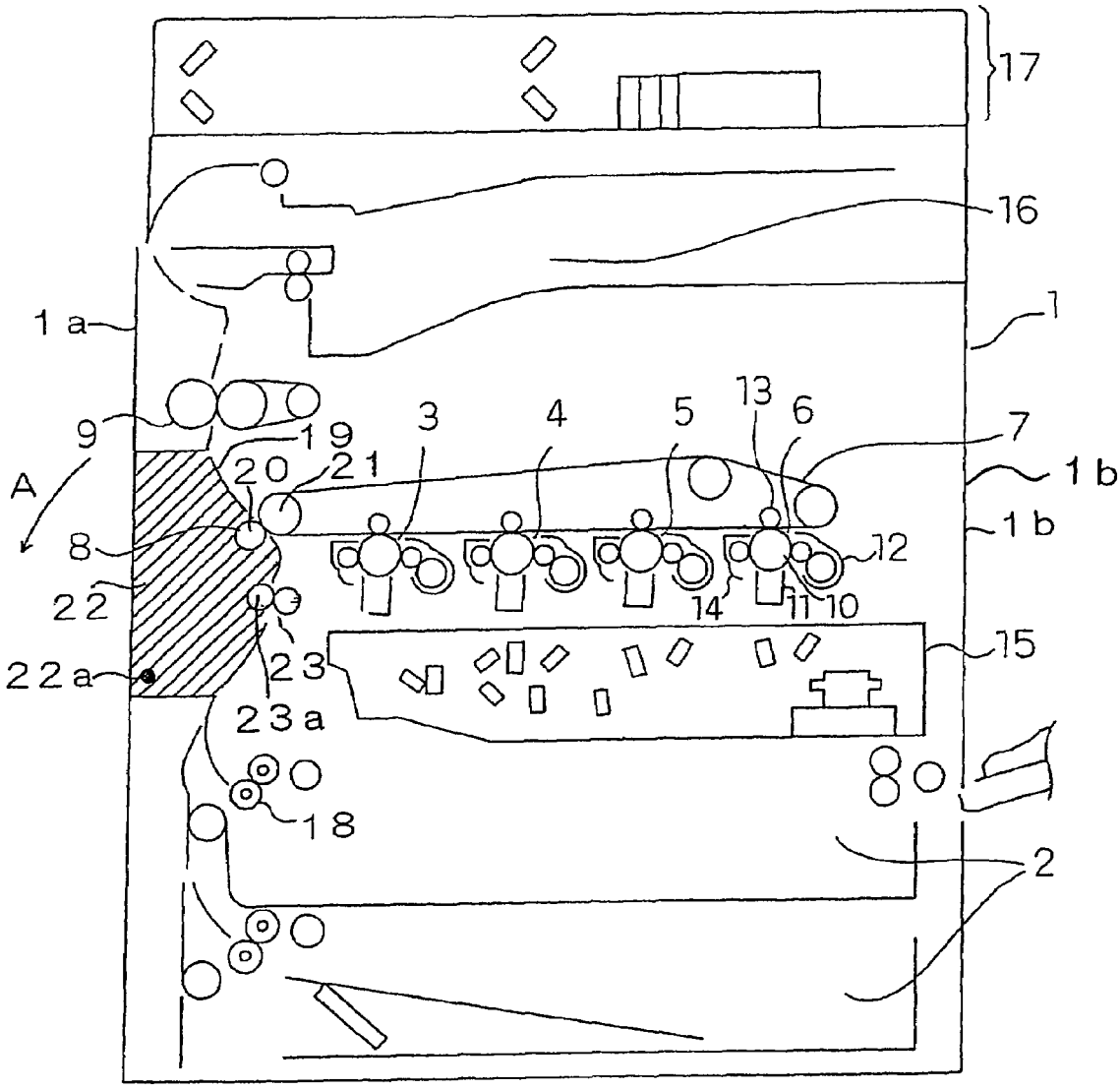
FIG. 1 is a cross-sectional overall configuration diagrammatical view of a photocopier in accordance with a preferred embodiment of the present invention.

FIG. 1 is a cross-sectional view of a photocopier (image forming apparatus) 1 that uses the transport unit 22 according to the present embodiment. The photocopier 1 shown in FIG. 1 includes a pair of sheet supply cassettes 2 in the bottom portion that house sheets, and a document reading unit 17 in the top portion that reads images of documents. The document reading unit 17 includes a light exposure lamp, a lens, a mirror, and so on.

Also, the photocopier in FIG. 1 is a tandem type color photocopier that includes a black image forming unit 3, a yellow image forming unit 4, a cyan image forming unit 5, and a magenta image forming unit 6. Further, an intermediate transfer belt 7 is provided onto which each image formed in the image forming units 3, 4, 5, and 6 is superimposed. The basic structure of the image forming units 3, 4, 5, and 6 is the same or substantially the same, so here the magenta image forming unit 6 is explained as an example. As shown in FIG. 1, the magenta image forming unit 6 includes a photosensitive drum 10, a charging device 11, a developing device 12, a primary transfer roller 13, a cleaning unit 14, and so on.

Further, in the photocopier a laser scan unit (hereafter referred to as the LSU) 15 is disposed below the four image forming units 3, 4, 5, and 6. The laser scan unit 15 forms an electrostatic latent image on each photosensitive drum by scanning the surface of the photosensitive drum of each of the four image forming units 3, 4, 5, and 6.

Also, the photocopier includes a pair of secondary transfer rollers 8 to transfer toner images formed on the intermediate transfer belt 7 to sheets supplied from the sheet supply cassette 2, a fixing unit 9 to fix the transferred toner images onto the sheets, and a discharge tray 16 to discharge sheets on which the toner images have been fixed by the fixing unit 9.

Next, the sheet transport path is explained.

Sheets housed in the sheet supply cassette 2 are supplied by a pair of sheet supply rollers 18 disposed above the sheet supply cassette 2. The sheets are then transported via a pair of registration rollers 23 where any slanting of the sheets is corrected, the pair of secondary transfer rollers 8, and the fixing unit 9, to the discharge tray 16. Here, the pair of sheet supply rollers 18, the pair of secondary transfer rollers 8, and the fixing unit 9 are disposed along a side surface 1*a* of the main body 1, so a transport path 19 on which sheets are transported is formed along the side surface 1*a*.

Next, the pair of secondary transfer rollers 8 is explained.

The pair of secondary transfer rollers 8 includes a secondary transfer roller 20 disposed on the side surface 1*a* side sandwiching the transport path 19, and an opposing roller 21 disposed in a position in opposition to the secondary transfer roller 20 and sandwiching the intermediate transfer belt 7. The secondary transfer roller 20 presses against the opposing roller 21, and in this nip area the toner image formed on the intermediate transfer belt 7 is transferred to the sheet.

Next, a transport unit 22 supported so that it can be freely opened and closed with respect to the main body of the photocopier 1 is explained.

Using the transport path 19 as criterion, a portion on the side surface 1*a* side is formed as the transport unit 22. The transport unit 22 is shown hatched in FIG. 1. The secondary transfer roller 20 and a registration roller 23*a* are installed in the transport unit 22. The transport unit 22 can be opened outward (see arrow A in FIG. 1) about a support point 22*a* as center.

Figure 2:
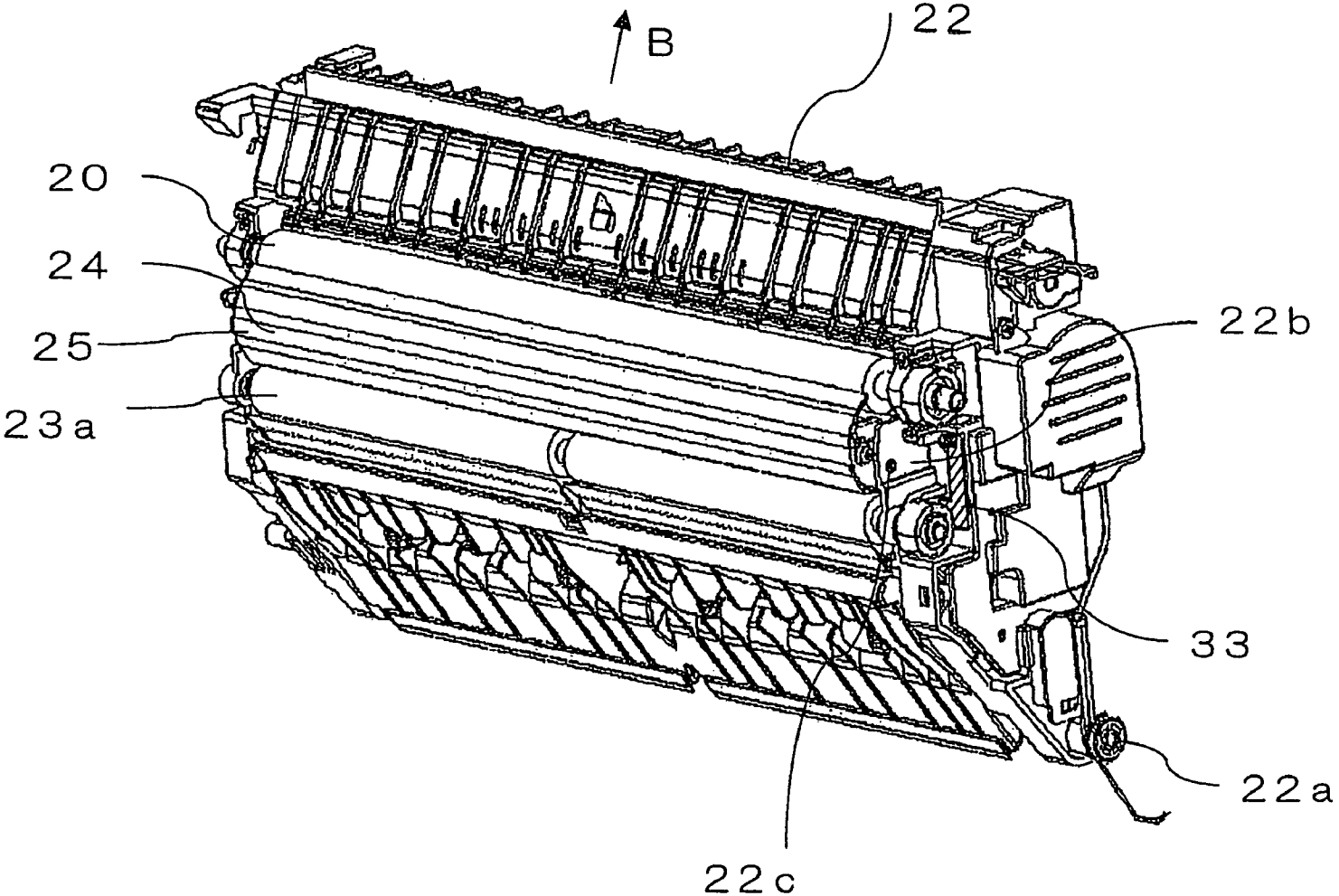
FIG. 2 is an isometric view of a transport unit of the photocopier in accordance with the preferred embodiment of the present invention.

FIG. 2 is an isometric view of the transport unit 22 viewed from the opposite side of the plane of the paper in FIG. 1 (the apparatus depth side). FIG. 2 shows the secondary transfer roller 20 and the registration roller 23*a* installed in the transport unit 22 at both ends in the axial direction. A guide unit 24 is provided between the secondary transfer roller 20 and the registration roller 23*a*. The guide unit 24 is removably installed on the transport unit 22 at both ends in the lengthwise direction (the direction at right angles to the direction of transport of sheets). In FIG. 2, the sheets are transported from below upwards; the direction of transport is indicated by the arrow B.

Figure 3:
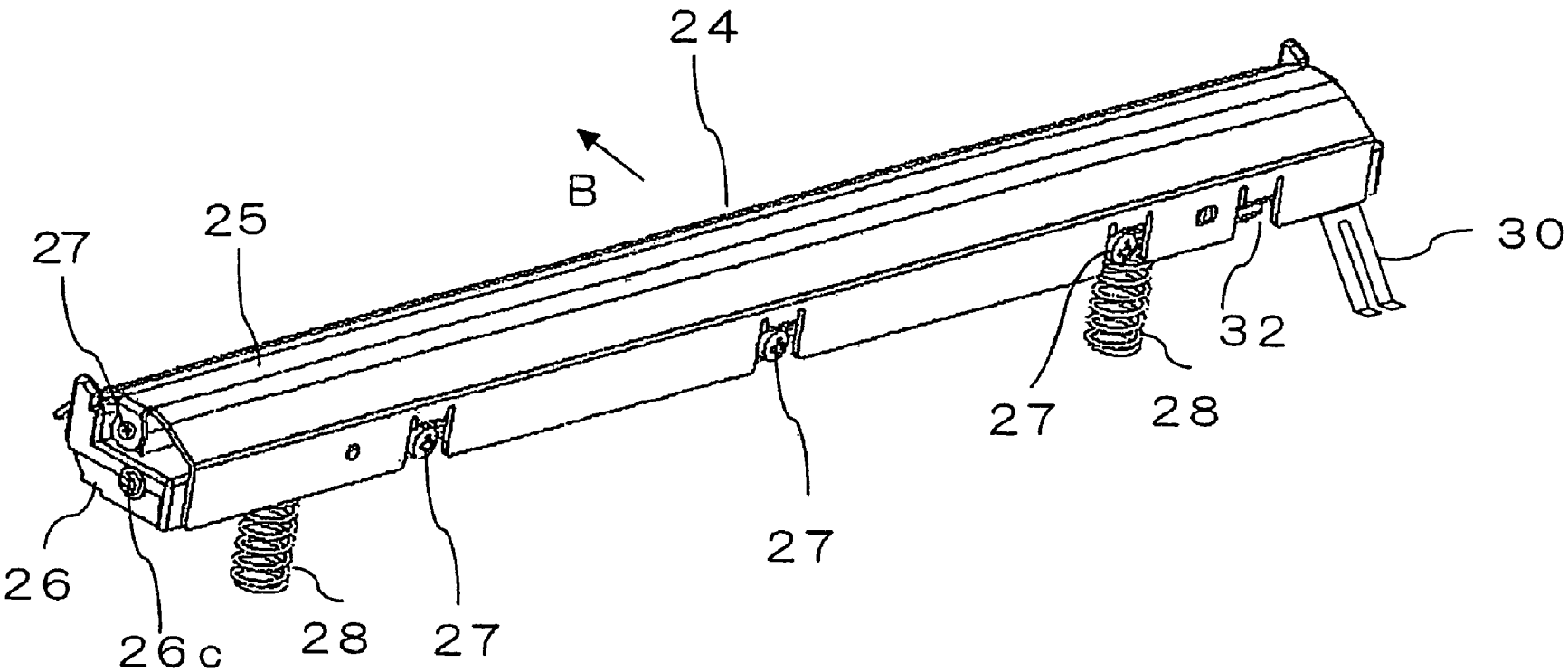
FIG. 3 is an isometric view seen from above of a guide unit of the transport unit in accordance with the preferred embodiment according to the present invention.
Figure 4:
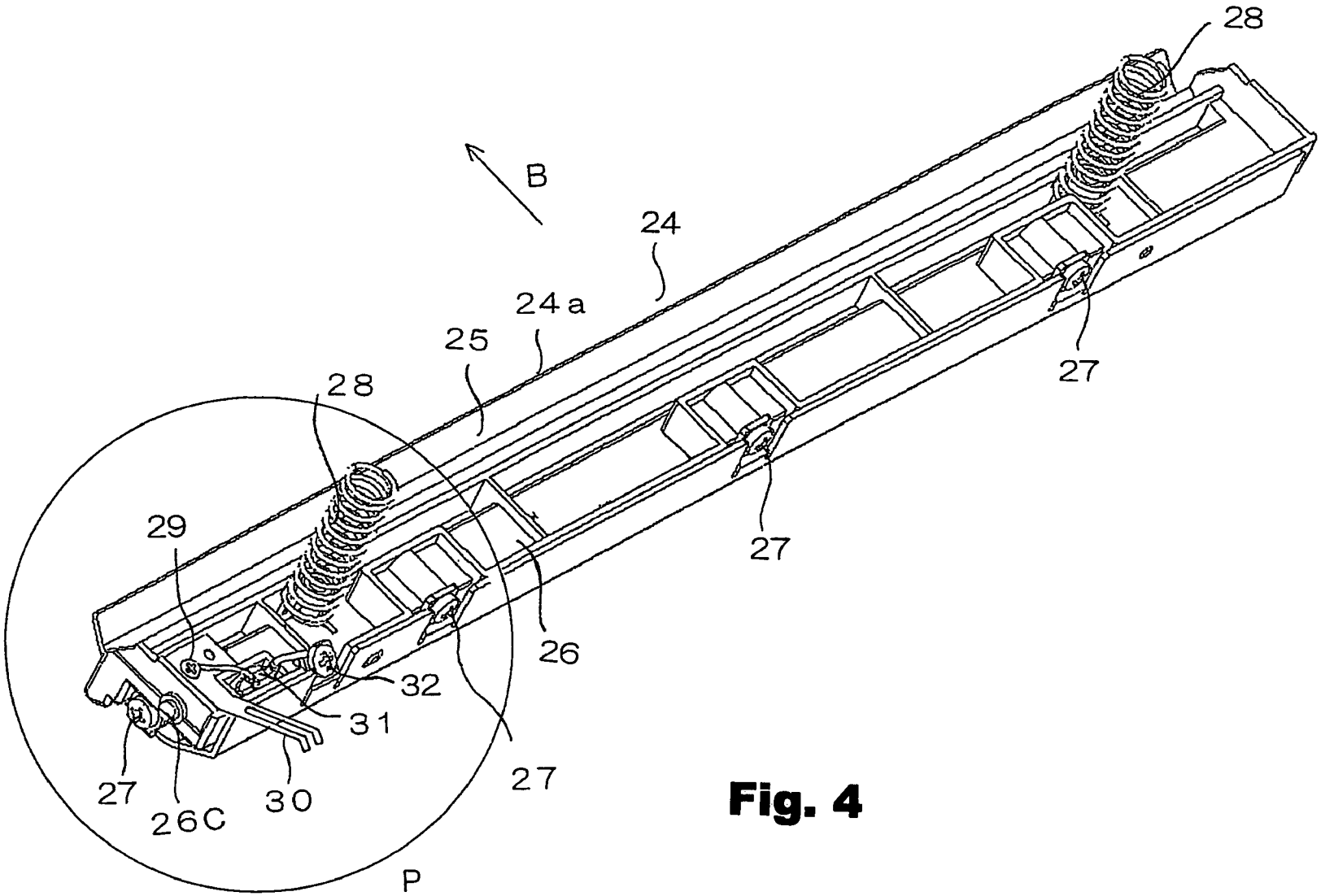
FIG. 4 is an isometric view seen from below of the guide unit.
Figure 5:
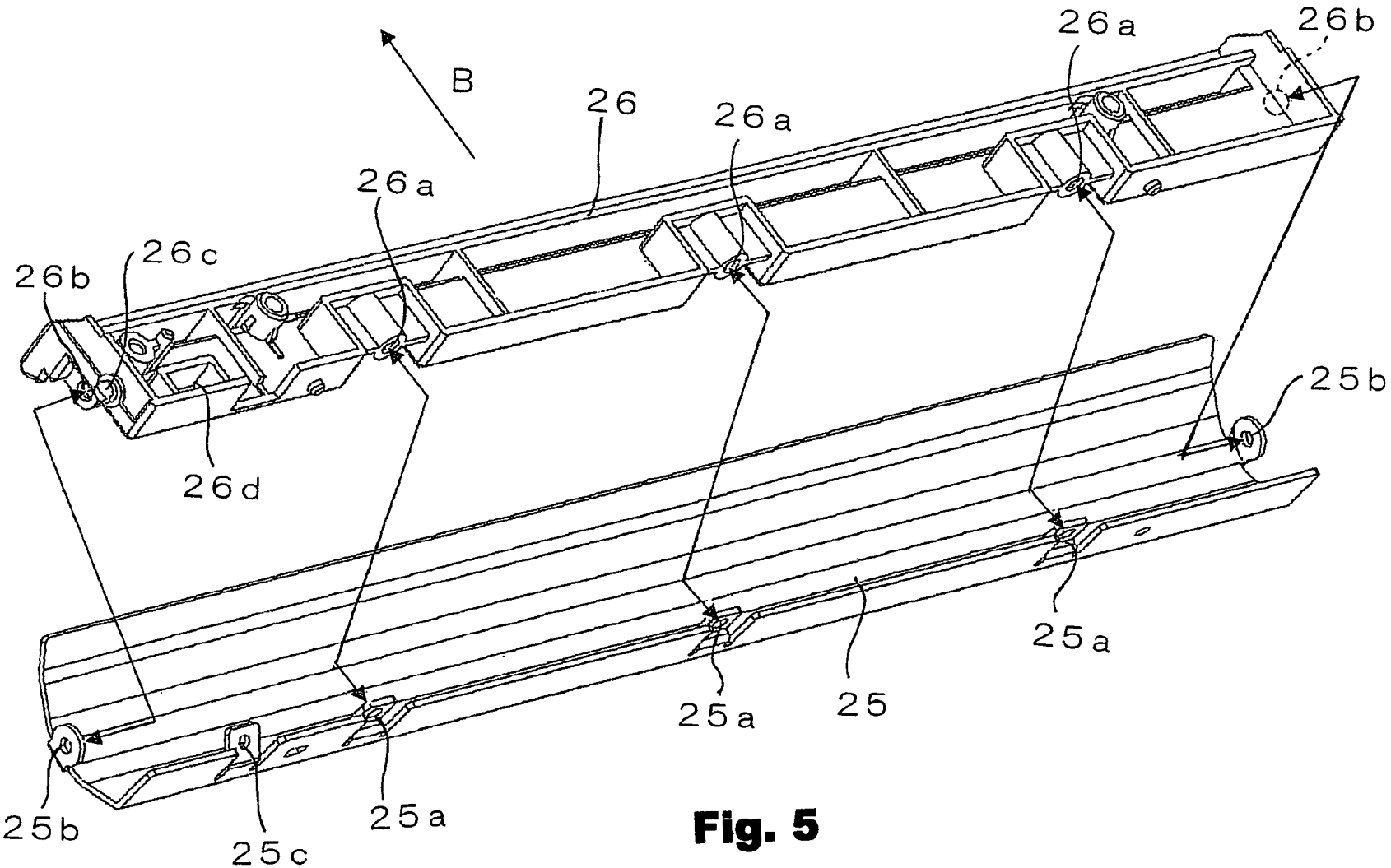
FIG. 5 is an exploded view of the guide plate and support member of the guide unit.

FIG. 3 is an isometric view of the top surface of the guide unit 24. FIG. 4 is an isometric view of the bottom surface of the guide unit 24. As shown in FIGS. 3 and 4, the guide unit 24 includes an electrically conducting guide plate 25 that forms part of the transport path 19, and an electrically insulating support member 26 that supports the guide plate 25 from below. FIG. 5 is a diagrammatic view showing the exploded state of the guide plate 25 and the support member 26 shown in FIG. 4. In FIGS. 3, 4, and 5, the sheet transport direction is indicated by the arrow B. In the present embodiment, the electrically conducting guide plate 25 is formed from an electrogalvanized steel plate (commercial name: SILVERTOP-ECO), and the electrically insulating support member 26 is formed from modified PPE (commercial name: Noryl)

As shown in FIGS. 4 and 5, the guide plate 25 preferably has three through holes 25*a* and two through holes 25*b*. The three through holes 25*a* are in the rear end portion of the guide plate 25 in the direction of transport of sheets, and are provided in a line at predetermined intervals in the lengthwise direction at right angles to the direction of transport of the sheets. Also, the two through holes 25*b* are formed at both ends in the lengthwise direction. On the other hand, the support member 26 has three screw holes 26*a* formed in a line at predetermined intervals in the lengthwise direction in the rear end portion in the direction of transport of the sheets, and two screw holes 26*b* formed at both ends in the lengthwise direction. The guide plate 25 and the support member 26 are mutually connected by aligning the through holes 25*a* and the screw holes 26*a*, and aligning the through holes 25*b* and the screw holes 26*b*, and screwing screws 27 into each screw hole (see FIGS. 5 and 6).

At both ends in the lengthwise direction of the support member 26, projections 26*c* are formed, each projecting outwards. The guide unit 24 is installed in the transport unit 22 by fitting the projections 26*c* into through holes 22*c* formed in installation plates 22*b* of the transport unit 22 (see FIG. 2). The side of the transport unit 22 that is not shown in FIG. 2 (the left side in FIG. 2) has the same or similar structure as the side that can be seen (the right side in FIG. 2), but is preferably a mirror image. In the portion on the left side the installation plate 22*b* and the through hole 22*c* are provided, and the projection 26*c* is fitted into the through hole 22*c*, in the same way.

Also, spring members 28 are installed on the rear surface of the support member 26 near both ends in the lengthwise direction (see FIG. 4). When the guide unit 24 is installed on the transport unit 22, the front edge 24*a* of the guide unit 24 is pressed in the upward direction in FIG. 3 (towards the side surface 1*b* in FIG. 1) with the projections 26*c* as support points, by the spring members 28.

Figure 6:
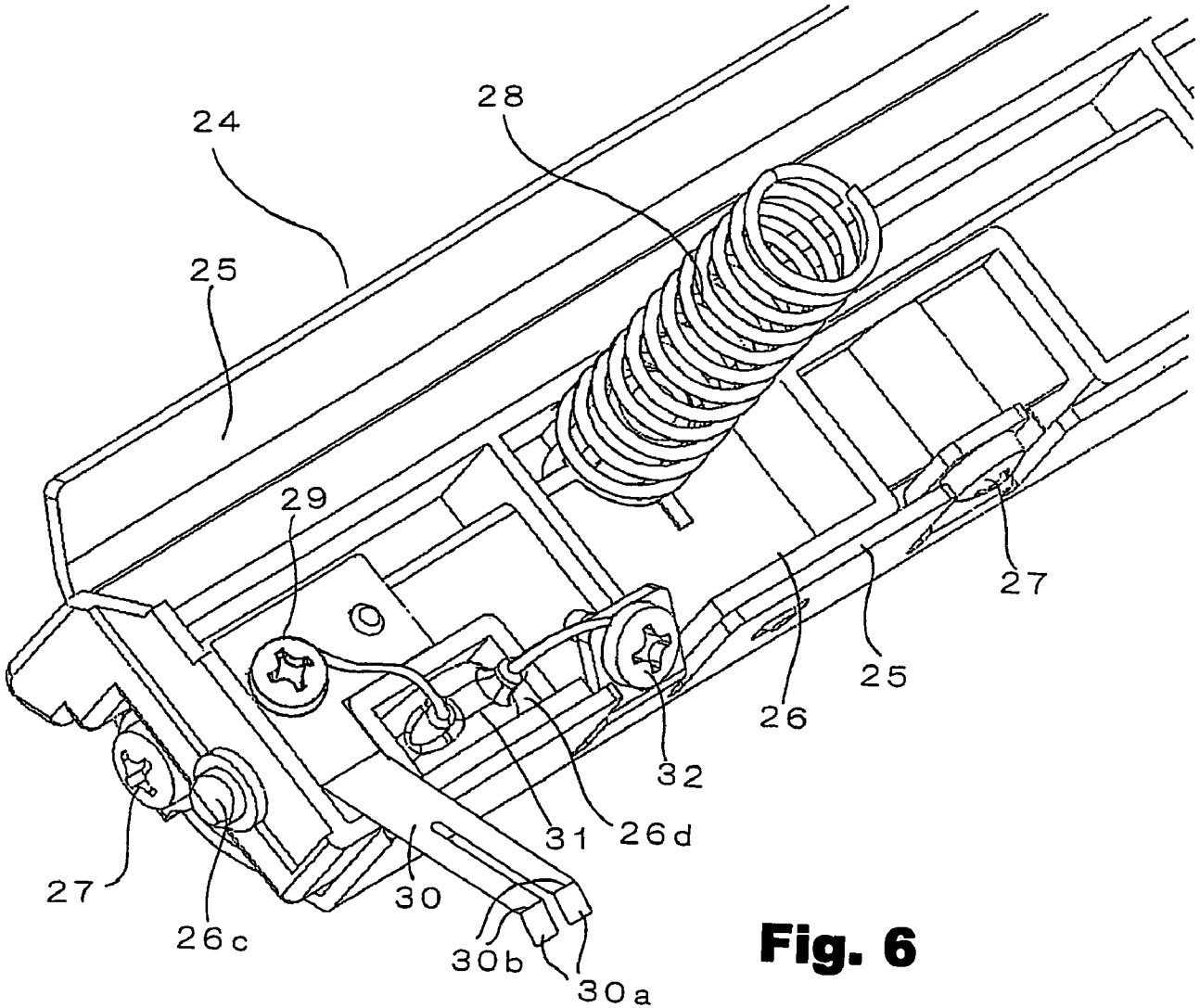
FIG. 6 is a partial enlarged isometric view seen from below of the guide unit.

FIG. 6 is an enlargement of the part P in FIG. 4. As shown in FIG. 6, at one end in the rear surface in the lengthwise direction of the support member 26, a blade spring member 30 is fastened by a screw 29. Also, in the rear surface of the support member 26, adjacent to and to the inside of the blade spring member 30 a depression portion 26*d* is formed, and a varistor 31 is embedded in the depression portion 26*d* (see FIGS. 5 and 6). A terminal at one end of the varistor 31 is connected to the screw 29. Also, as shown in FIG. 5, a screw hole 25*c* is formed at one end in the lengthwise direction of the guide plate 25. The screw hole 25*c* is located near the varistor 31 on the guide unit 24. A screw 32 screwed into the screw hole 25*c* is connected to another terminal of the varistor 31. The screw 32 is for electrically connecting the terminal of the varistor 31 to the guide plate 25, and is not fixed to the support member 26. The varistor 31 is an example of a non-linear element in the present invention. If the applied voltage is smaller than a predetermined value, current does not flow, but if the applied voltage is equal to or greater than the predetermined value the resistance reduces, and current flows. Instead of a varistor, a Zener diode may be used. Also, in the present embodiment, a varistor with a predetermined value of 470V is used, as an example.

Figure 7:
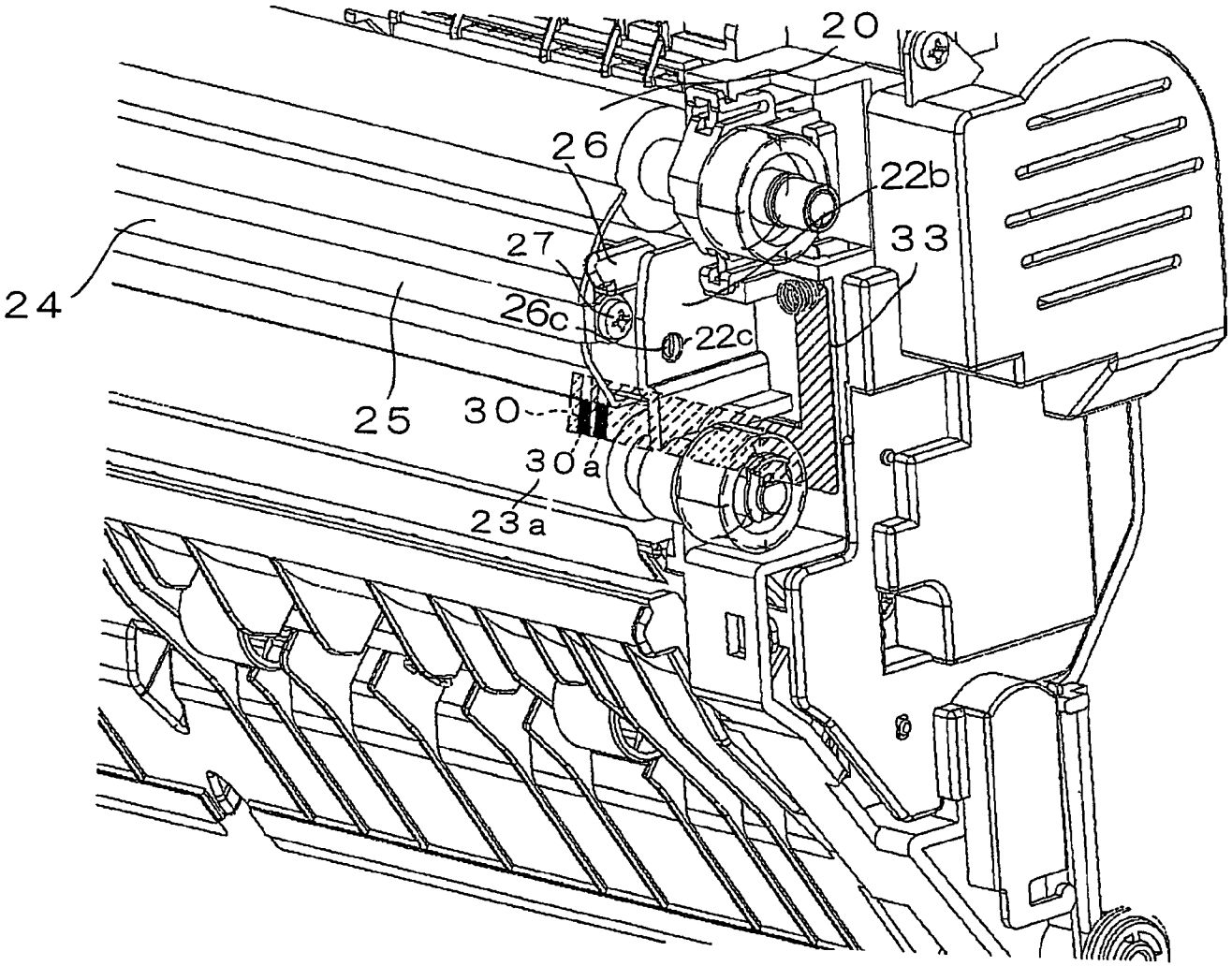
FIG. 7 is a partial enlarged isometric view of the transport unit.

FIG. 7 shows an enlargement of the end portion of the transport unit 22 shown in FIG. 2. As shown in FIG. 7, an L-shaped ground plate 33 that is grounded is provided on the front surface of the transport unit 22 near an end of the guide unit 24 in the lengthwise direction. The rear surface 30*b* of an end 30*a* of the blade spring member 30 referred to above (see FIG. 6) is pressed against the front surface of the ground plate 33 by the elastic force of the blade spring member 30, so the blade spring member 30 is electrically connected to the ground plate 33. In other words, referring to FIGS. 6 and 7, the guide plate 25 is electrically connected to the ground plate 33 via the varistor 31 that is connected to the guide plate 25 by the screw 32, and the blade spring member 30 that is connected to the other terminal of the varistor 31. The ground plate 33 is electrically grounded (GND) via the main body of the photocopier 1. Also, as can be seen by comparing FIG. 1 and FIG. 7, a part of the blade spring member 30 and the ground plate 33 is disposed below the registration roller 23*a*.

Also, a transfer device according to the present invention includes the secondary transfer roller 20 according to the present embodiment. The transfer unit according to the present embodiment includes the transfer device, the supply rollers 18, registration rollers 23, and guide unit 24. The intermediate transfer belt 7 according to the present embodiment is equivalent to the image carrier according to the present invention. Also, the secondary transfer roller 20 according to the present embodiment is equivalent to an example of a transfer roller according to the present invention. Also, the blade spring member 30 according to the present embodiment is equivalent to an example of the connecting member according to the present invention. The varistor 31 according to the present embodiment is equivalent to an example of the non-linear element according to the present invention. Also, the image forming units 3, 4, 5, and 6, the LSU 15, and the opposing roller 21 are equivalent to an example of the image forming unit according to the present invention.

The following is an explanation of the operation of the transport unit 22 according to the present embodiment with the structure as described above. At the same time an example of the operation of the guide unit 24 is also explained.

In the photocopier shown in FIG. 1, when a document is read by the document reading unit 17, and copying starts, a sheet is transported from the sheet supply cassette 2 to the transport path 19 by the pair of sheet supply rollers 18.

Then, if the transported sheet is transported slanted with respect to the transport direction, this is corrected at the pair of registration rollers 23. Then the toner image formed on the intermediate transfer belt 7 based on the document that was read is transferred onto the sheet by the voltage applied to the secondary transfer roller 20.

Next, the toner image that was transferred onto the sheet is fixed in the fixing unit 9, and discharged to the discharge tray 16.

When transfer is being carried out by the secondary transfer roller 20, even if, for example, a sheet is transported when the humidity is high, the guide plate 25 is connected to ground via the varistor 31. Therefore, it is possible to suppress the flow of transfer current through the sheet to the guide plate 25, so it is possible to reduce the occurrence of transfer defects. This is because during transfer, a voltage of about 1.5 kV is applied to the secondary transfer roller 20. However, as the sheet is interposed, the voltage between the guide plate 25 and the ground plate 33, in other words, the voltage between both ends of the varistor 31, is less than the predetermined value 470V. Therefore the resistance value of the varistor 31 remains large, and little current flows.

On the other hand, if the guide plate 25 is charged by friction between a sheet and the guide plate 25 during sheet transport, if the charging causes a potential difference between the guide plate 25 and the ground plate 33 of 470V or more, the resistance value of the varistor 31 becomes smaller so that current can flow. Therefore the charge on the guide plate 25 is dissipated by discharge via the varistor 31.

In this way, in the present embodiment, transfer defects caused by the flow of transfer current to the guide plate 25 are suppressed. In addition, it is possible to suppress charging of the guide plate 25.

In the present embodiment, a varistor with a predetermined value of 470V was used; however, the value may be changed as appropriate to suit the location of installation of the photocopier. In other words, if the photocopier is installed in a high temperature high humidity area, transfer current can easily flow to the guide plate. Therefore it is necessary to use a varistor with a high predetermined value.

Also, as stated above, the guide unit 24 according to the present embodiment is installed in the transport unit 22 by just the projections 26*c*. Therefore it is easy to remove each varistor 31. Therefore, if the predetermined value of the varistor installed during manufacture is not suitable for the actual environment in which the photocopier is installed, just the guide unit 24 needs to be changed. Therefore adjustment to suit the environment is easy.

The present embodiment was explained for a case in which the guide unit 24 is used in a tandem type color photocopier. However, a one-drum type color photocopier, or a monochrome photocopier may also be used. If a monochrome type photocopier is used, there is no need to provide an intermediate transfer belt. Therefore, the guide unit 24 is disposed between the transfer roller which is disposed in opposition to the photosensitive drum and the registration rollers. In this case, the photosensitive drum is equivalent to an example of the image carrier according to the present invention.

Also, in the present embodiment, paper was used as an example of the sheet onto which toner images are transferred in the present invention. However, OHP sheets may also be used.

The guide unit and transport unit according to the present invention are effective for suppressing the flow of transfer current to the guide plate, and are useful in image forming apparatus such as facsimile machines, printers, photocopiers, and so on.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming apparatus equipped with the present invention. Accordingly, these terms, as utilized to describe the present invention should be interpreted relative to an image forming apparatus equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus guide unit being configured to guide toner image transfer sheets between an image carrier and a transfer device, comprising:

an electrically conducting guide plate being disposed upstream of the transfer device in the direction of transport of sheets;

an electrically insulating support member being configured to support the guide plate;

an electrically conducting connecting member being installed on the support member, and connected to a ground plate provided on a main body of the image forming apparatus; and a non-linear element being electrically connected between the guide plate and the connecting member such that when a voltage being equal to or greater than a predetermined value is applied to the guide plate, a resistance value is reduced compared to a case in which the applied voltage is not greater than the predetermined value.

2. The image forming apparatus guide unit according to claim 1, wherein the non-linear element is a varistor or a Zener diode.

3. The image forming apparatus guide unit according to claim 1, wherein the predetermined value is configured to be changed in accordance with the non-linear element.

4. The image forming apparatus guide unit according to claim 1, wherein the connecting member is an elastic plate-shaped member, and a surface of the connecting member that contacts the ground plate is pressed against the ground plate by the elastic force of the connecting member.

5. A transport unit provided in an image forming apparatus having an image carrier, being configured to transport toner image transfer sheets, comprising:

a transfer device being configured to transfer toner images formed on the image carrier to transported sheets;

a registration roller being disposed upstream of the transfer device in the direction of transport of the sheets, the registration roller being configured to correct slanted feeding of the sheets; and a guide unit being provided between the transfer device and the registration roller, the guide unit being configure to guide toner image transfer sheets between the image carrier and the transfer device, the guide unit including an electrically conducting guide plate being disposed upstream of the transfer device in the direction of transport of sheets, an electrically insulating support member being configured to support the guide plate, an electrically conducting connecting member being installed on the support member, and being connected to a ground plate provided on a main body of the image forming apparatus, and a non-linear element electrically being connected between the guide plate and the connecting member such that when a voltage equal to or greater than a predetermined value is applied to the guide plate, a resistance value is reduced compared to a case in which the applied voltage is not greater than the predetermined value.

6. The image forming apparatus transport unit according to claim 5, further comprising a pair of installation plates each having a through hole provided at both ends in a lengthwise direction at right angles to the direction of transport of the sheets, and the guide unit is provided with projections at both ends in the lengthwise direction that project outward and are inserted into the through holes to support the guide unit on the installation plates.

7. An image forming apparatus, comprising:

a sheet supply cassette being configured to house toner image transfer sheets;

an image forming unit having an image carrier having a surface, toner images being formed on the surface of the image carrier;

a fixing unit being configured to fix toner images onto sheets;

a transport unit being configured to transport sheets from the sheet supply cassette to the fixing unit; and a discharge tray being configured to receive sheets discharged from the fixing unit, the transport unit including a transfer device being configured to transfer toner images formed on the image carrier to transported sheets, a registration roller being disposed upstream of the transfer device in the direction of transport of the sheets, and being configured to correct slanted feeding of the of the sheets, and a guide unit being provided between the transfer device and the registration roller, and being configured to guide toner image transfer sheets between the image carrier and the transfer device, the guide unit including an electrically conducting guide plate being disposed upstream of the transfer device in the direction of transport of sheets, an electrically insulating support member being configured to support the guide plate, an electrically conducting connecting member being installed on the support member, being connected to a ground plate provided on a main body of the image forming apparatus, and a non-linear element electrically being connected between the guide plate and the connecting member, when a voltage equal to or greater than a predetermined value is applied to the guide plate, a resistance value is reduced compared to a case in which the applied voltage is not greater than the predetermined value.

8. The image forming apparatus according to claim 7, wherein the transfer device includes a transfer roller, and the transfer roller presses against the image carrier.

* * * * *